US006630906B2

(12) United States Patent
Tomomatsu et al.

(10) Patent No.: US 6,630,906 B2
(45) Date of Patent: Oct. 7, 2003

(54) CHIP ANTENNA AND MANUFACTURING METHOD OF THE SAME

(75) Inventors: Isao Tomomatsu, Tokyo (JP); Masayuki Ishiwa, Tokyo (JP); Takahiro Ueno, Tokyo (JP); Toshiyuki Imagawa, Tokyo (JP); Minoru Oozeki, Tokyo (JP)

(73) Assignees: The Furukawa Electric Co., Ltd., Tokyo (JP); Sony Corporation, Tokyo (JP)

( * ) Notice: Subject to any disclaimer, the term of this patent is extended or adjusted under 35 U.S.C. 154(b) by 0 days.

(21) Appl. No.: 09/909,912

(22) Filed: Jul. 20, 2001

(65) Prior Publication Data

US 2002/0027530 A1 Mar. 7, 2002

(30) Foreign Application Priority Data

Jul. 24, 2000 (JP) ..... 2000-221582
Feb. 19, 2001 (JP) ..... 2001-041062

(51) Int. Cl.[7] ..... H01Q 1/38
(52) U.S. Cl. ..... 343/700 MS; 343/873
(58) Field of Search ..... 343/700 MS, 873, 343/895, 702, 798, 800; H01Q 1/38

(56) References Cited

U.S. PATENT DOCUMENTS 5,087,920 A * 2/1992 Tsurumaru et al. .. 343/700 MS
5,448,250 A * 9/1995 Day ..... 343/700 MS
5,559,524 A 9/1996 Takei et al. ..... 343/895
5,892,490 A 4/1999 Asakura et al. ..... 343/895
5,898,413 A 4/1999 Mandai et al. ..... 343/895
5,973,651 A * 10/1999 Suesada et al. ..... 343/702
6,075,491 A * 6/2000 Dakeya et al. ..... 343/700 MS
6,133,880 A * 10/2000 Grangeat et al. .... 343/700 MS
6,304,220 B1 * 10/2001 Herve et al. ..... 428/364
6,320,545 B1 * 11/2001 Nagumo et al. ..... 343/700 MS
6,323,811 B1 * 11/2001 Tsubaki et al. ..... 439/497
6,359,589 B1 * 3/2002 Bae ..... 343/700 MS
6,380,895 B1 * 4/2002 Moren et al. ..... 343/700 MS
6,388,626 B1 * 5/2002 Gamalielsson et al. ..... 343/700 MS
6,456,246 B2 * 9/2002 Saito ..... 343/702
2002/0075186 A1 * 6/2002 Hamada et al. ..... 343/700 MS
2002/0080076 A1 * 6/2002 Kamei et al. ..... 343/700 MS
2002/0105497 A1 * 8/2002 Jin et al. ..... 345/157

FOREIGN PATENT DOCUMENTS

EP 0 762 539 A1 3/1997 ..... H01Q/13/20
EP 0 893 841 A1 1/2001 ..... H01Q/11/08
EP 1 291 963 A1 3/2003 ..... H01Q/1/36
JP 2000 059125 2/2000 ..... H01Q/1/38
WO WO 0108258 A1 2/2001 ..... H01Q/1/38

* cited by examiner

*Primary Examiner*—Don Wong
*Assistant Examiner*—Trinh Vo Dinh
(74) *Attorney, Agent, or Firm*—Knobbe Martens Olson & Bear LLP

(57) ABSTRACT

A chip antenna comprises an antenna conductor, and a dielectric chip which stacks on a portion of the antenna conductor, in which a conductor exposed portion of the antenna conductor which is not overlapped on the dielectric chip is bent along the surface of the dielectric chip.

21 Claims, 11 Drawing Sheets

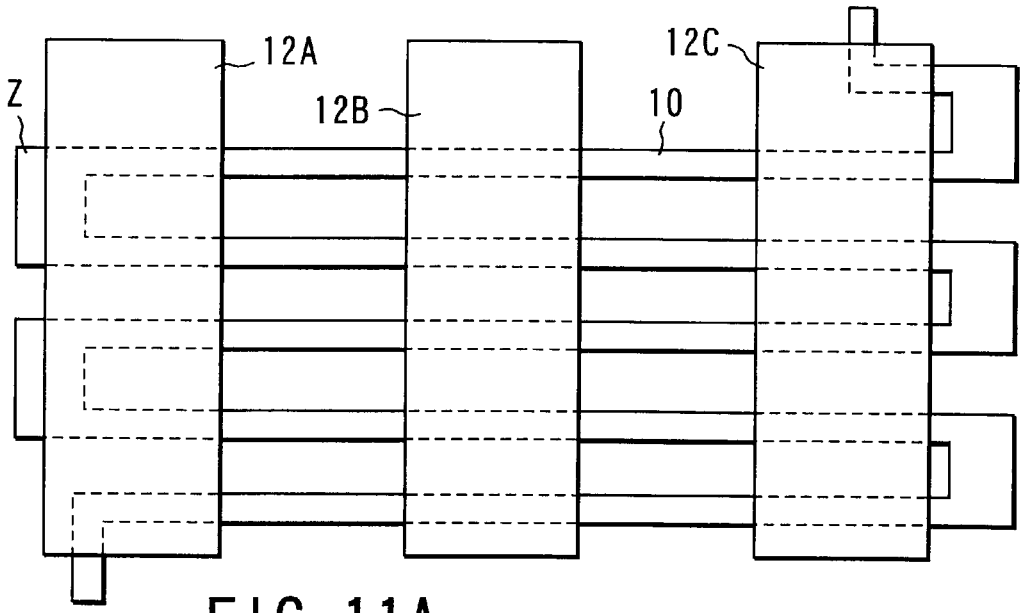
FIG. 11A
FIG. 11B
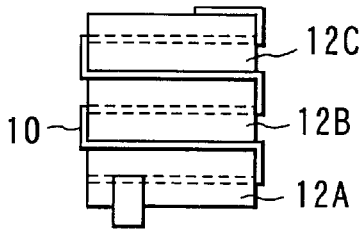
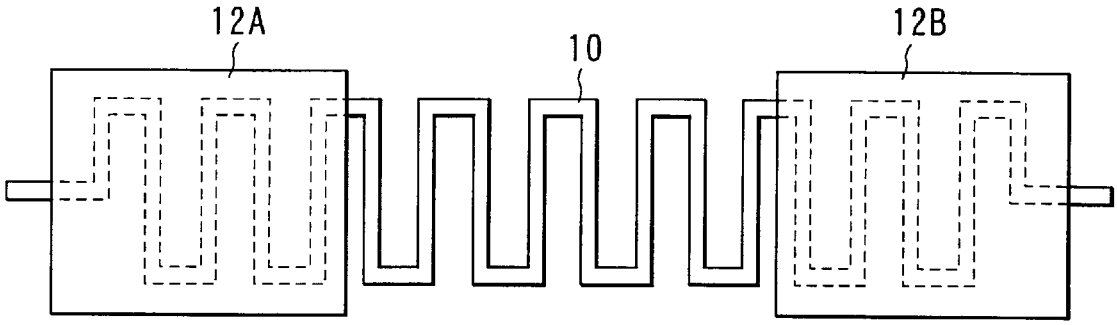
FIG. 12A
FIG. 12B
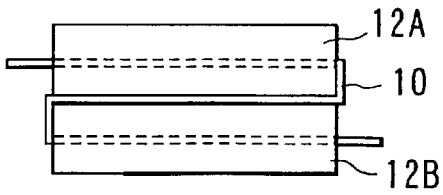

CHIP ANTENNA AND MANUFACTURING METHOD OF THE SAME

CROSS-REFERENCE TO RELATED APPLICATIONS

This application is based upon and claims the benefit of priority from the prior Japanese Patent Applications No. 2000-221582, filed Jul. 24, 2000, No. 2001-041062, filed Feb. 19, 2001, the entire contents of both of which are incorporated herein by reference.

BACKGROUND OF THE INVENTION

1. Field of the Invention

The present invention relates to a small-sized chip antenna for use in terminal apparatuses such as a mobile phone, mobile information terminal, and radio local area network (LAN), and a manufacturing method of the chip antenna.

2. Description of the Related Art

It is an important problem to miniaturize an antenna of a mobile phone, or the like. Therefore, various types of small antennas have heretofore been proposed. As one of the small antennas, a chip antenna in which an antenna conductor is formed in a meandered shape and buried in a dielectric material is known (see Jpn. Pat. Appln. KOKAI Publication No. 10-145123).

In this type of antenna has an advantage that a length of the antenna can be reduced as compared with a whip antenna, since the conductor is meandered. However, the meandered antenna has a large width.

BRIEF SUMMARY OF THE INVENTION

An object of the present invention is to provide a miniaturized chip antenna.

A chip antenna according to the present invention is characterized by comprising: an antenna conductor, and a dielectric chip which stacks on a portion of the antenna conductor, in which a conductor exposed portion of the antenna conductor which is not overlapped on the dielectric chip is bent along the surface of the dielectric chip.

With this constitution, a size of the dielectric chip can be reduced by a size of the conductor which is not overlapped in the dielectric chip. Therefore, according to the present invention, the whole chip antenna can be miniaturized.

A manufacturing method of a chip antenna according to the present invention is characterized by comprising forming a conductor pattern having a meandered conductor, and forming a dielectric chip so as to overlap at least a portion of the meandered conductor in a meander width direction or a meander pitch direction in the dielectric chip. It is preferable that the conductor pattern has a pattern in which the meandered conductor and a frame to surround the meandered conductor are integrally formed, and after forming the dielectric chip, the meandered conductor is separated from the frame and a portion excluding a portion which is buried in the dielectric chip is bent along a surface of the dielectric chip. According to this manufacturing method, deformation of the meandered conductor can be controlled when the dielectric chip is formed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

FIGS. 11A and 11B are a plan view of the semimanufactures and a front view of the finished goods according to a ninth embodiment of the chip antenna of the present invention, respectively;

FIGS. 12A and 12B are a plan view of the semimanufactures and a side view of the finished goods according to the tenth embodiment of the chip antenna of the present invention, respectively;

DETAILED DESCRIPTION OF THE INVENTION

Embodiments of the present invention will be described hereinafter with reference to the drawings.

[First Embodiment]

Figure 1:
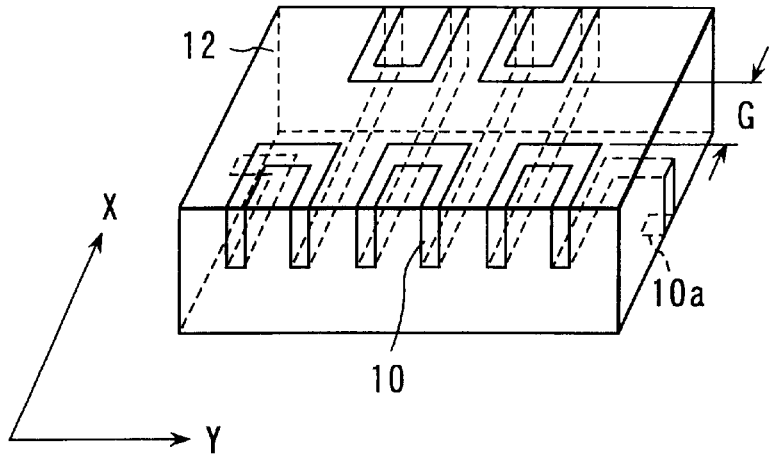
FIG. 1 is a perspective view of a chip antenna according to the first embodiment of the present invention.

FIG. 1 is a schematic view of a chip antenna according to the first embodiment of the present invention. The chip antenna has a conductor 10 and a dielectric chip 12. The conductor 10 is formed in a meandered shape. The dielectric chip 12 sandwiches a middle portion of the meandered conductor 10 in a meander width direction and the middle portion thereof is buried in the dielectric chip 12. Both end portions of the meandered conductor 10 (i.e., portions which are not buried in the dielectric chip 12 and which will be referred to as a "conductor exposed portion" in the following description) in the meander width direction (X direction in FIG. 1) are bent along the surface of the dielectric chip 12. One end portion of the meandered conductor 10 is bent along the end surface of the dielectric chip 12 to form a feed terminal 10*a*. Another end portion of the meandered conductor 10 is an open end.

An example of a chip antenna size will be described. The conductor 10 has a thickness of 0.07 mm, width of 0.20 mm, meander length of 8.225 mm, meander width of 5.20 mm, meander pitch of 1.07 mm, and 7.5 meandering times. The dielectric chip has a width of 3 mm, length of 10 mm, a thickness of 1 mm, and a permittivity of 20. The dielectric chip is formed in a composite material, which is made by mixing the ceramics in the resin. A center frequency of the chip antenna is 1.738 GHz. The center frequency of the chip antenna is adjusted by changing the pattern etc. of the chip antenna 10. An antenna for the frequency currently used in the mobile phone is exemplified in the seventeenth embodiment.

As described above, in the present invention, since the conductor exposed portion is bent along the surface of the dielectric chip 12, the length of the antenna conductor can be secured with a smaller size. Therefore, the size of the antenna conductor in the meander width direction (X direction in FIG. 1) can be reduced as compared with the conventional ones. Moreover, when a distance G between both end portions of the conductor in the meander width direction is reduced in FIG. 1, the antenna conductor with the same size in the meander width direction can be lengthened. Therefore, the size of the chip antenna in a length direction can be more reduced.

Figure 2A:
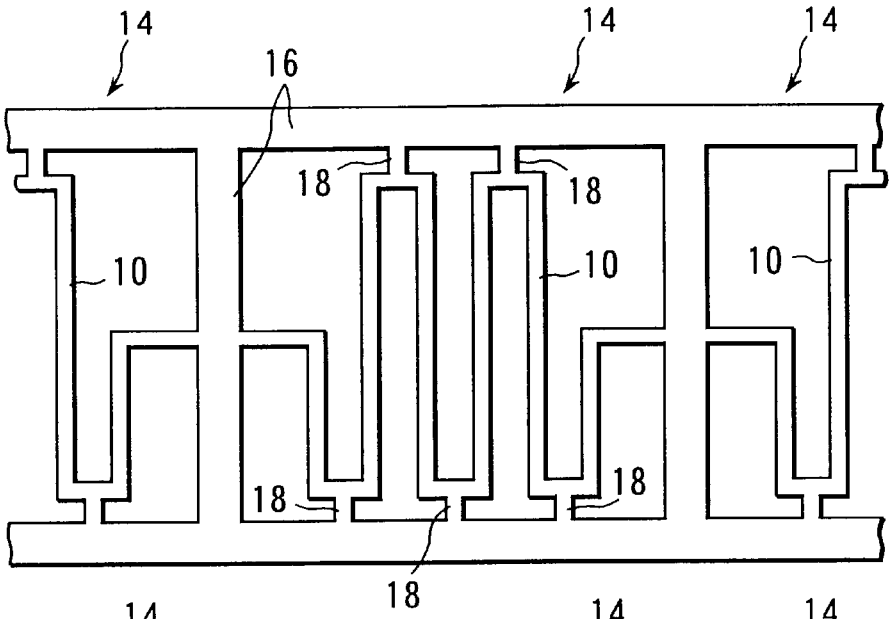
FIGS. 2A to 2C are explanatory views showing a manufacturing method of the chip antenna of FIG. 1.
Figure 2B:
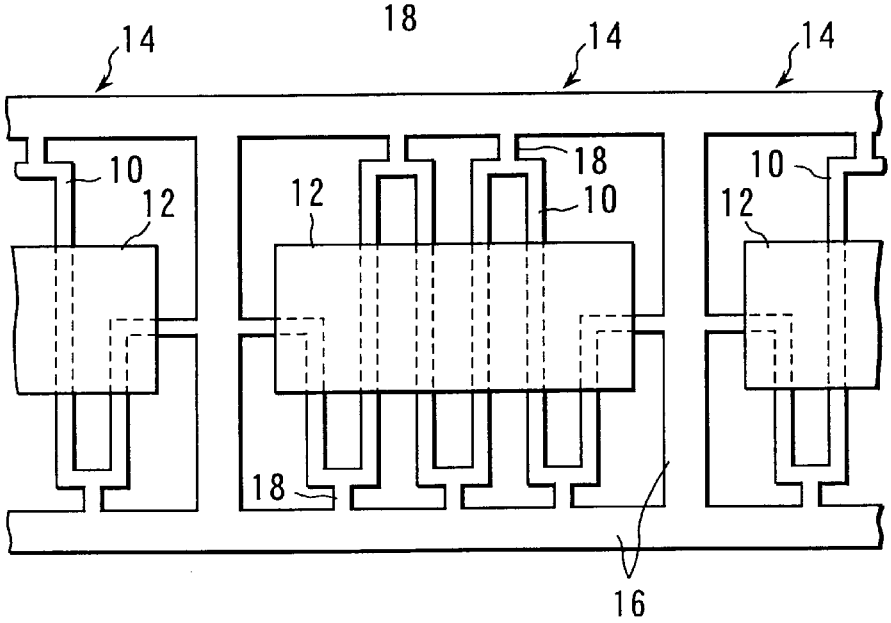
Figure 2C:
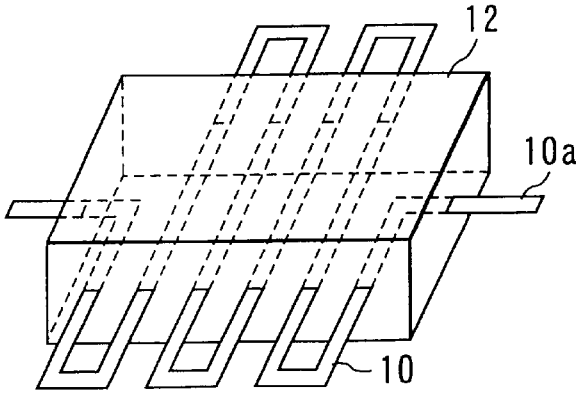

A manufacturing method of the chip antenna will be described with reference to FIGS. 2A to 2C. In FIGS. 2A to 2C, the same part as that of FIG. 1 is denoted with the same reference numeral.

First, a metal tape is processed to form a conductor pattern 14 as shown in FIG. 2A. A material is not limited to a tape shape, and may have a plate shape or a thin-film shape, and any shape may be used as long as the conductor pattern can be formed. For the sake of convenience, the material will be referred to as the "metal tape". The conductor pattern 14 has a conductor pattern in which the meandered conductor 10, frame 16, and bridge 18 are integrally formed. The frame 16 is formed to surround the meandered conductor 10. The frame 16 and a plurality of patterns of the meandered conductors 10 are repeatedly formed. The meandered conductors 10 are supported by the frame 16 through a plurality of bridges 18. Concretely, both end portions and U-turn portions of the meandered conductor 10 are preferably supported by the frame 16 via the bridge 18. Since the conductor is supported in this manner, the meandered shape is not easily damaged, and the conductor can easily be handled in subsequent steps. Additionally, it is preferably to continuously form a plurality of conductor patterns by repeatedly forming the conductor pattern 14 in the same metal shape.

Figure 3:
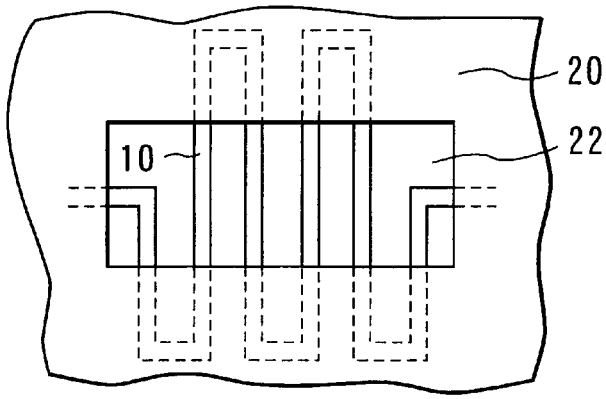
FIG. 3 is an explanatory view showing that a meandered conductor is set in a die in the manufacturing method of FIGS. 2A to 2C.

Subsequently, the conductor pattern 14 is set in a die for molding a dielectric material. As shown in FIG. 2B, the dielectric chip 12 is formed so that the middle portion of the meandered conductor 10 in the meander width direction is buried in the chip. In this case, both end portions and U-turn portions of the meandered conductor 10 are supported by the frame 16. Therefore, the meandered conductor 10 can easily be set in the die without damaging the meandered shape of the conductor. Furthermore, after the meandered conductor 10 is set in the die, both end portions of the conductor in the meander width direction are held by the die 20 as shown in FIG. 3. Therefore, even when the resin is pressed into a cavity 22, deformation defect of the meandered conductor 10 hardly occurs. Consequently, the dielectric chip 12 can be formed while a high size precision is maintained.

Subsequently, both end portions and bridge 18 of the meandered conductor 10 are cut so as to separate the meandered conductor 10 from the frame 16 (see FIG. 2C). Thereafter, both end portions of the meandered conductor 10 in the meander width direction (i.e., the conductor exposed portions) and one end portion thereof in the length direction are bent along the surface of the dielectric chip 12, then the chip antenna of FIG. 1 can be obtained. In order to stabilize positions of the bent meandered conductor 10 and feed terminal 10*a*, it is preferable to bond the meandered conductor 10 and feed terminal 10*a* on the surface of the dielectric chip 12.

According to the manufacturing method as mentioned above, the chip antenna of FIG. 1 can efficiently be manufactured, and a manufacturing cost can be reduced. Since size precision of the meandered conductor 10 is high, the chip antenna with a stable property can be obtained. Additionally, in the first embodiment, the metal tape may be used so as to function as the antenna, and a copper tape may be used considering from the cost. A punching processing, etching processing, and another processing are usually performed, but any processing method may be used as long as a desired precision is obtained. The aforementioned material and processing method of the antenna conductor will similarly apply to the following respective embodiments.

[Second Embodiment]

Figure 4A:
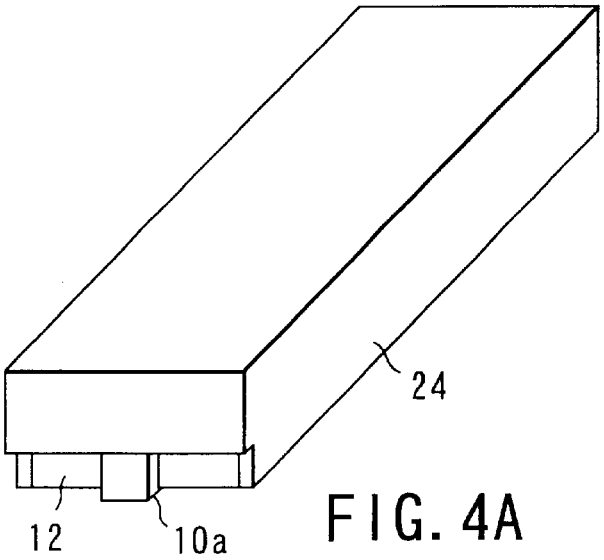
FIGS. 4A and 4B are a perspective view and sectional view showing the second embodiment of the chip antenna according to the present invention.
Figure 4B:
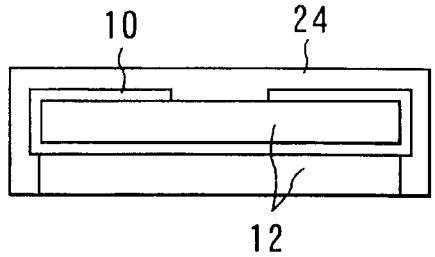

FIGS. 4A and 4B are constitutional views of the chip antenna according to the second embodiment of the present invention. In FIGS. 4A and 4B, the same part as that of FIG. 1 is denoted with the same reference numeral, and detailed description thereof will be omitted. In the chip antenna according to the second embodiment, a protection film 24 is disposed on the surface of the chip antenna of FIG. 1 to cover the meandered conductor 10 positioned on the surface of the dielectric chip 12. The protection film 24 can be formed by applying a coating or injection molding of a resin. When the protection film 24 is disposed, the portion of the meandered conductor 10 positioned on the surface of the dielectric chip 12 can be prevented from being deformed. Therefore, the stable property can be obtained. Furthermore, during mounting of the chip antenna, a handling apparatus is prevented from directly contacting the meandered conductor 10. Therefore, the meandered conductor 10 can be prevented from deviating a position or being damaged.

Additionally, when the protection film 24 is formed by injection molding, a material having a low viscosity is preferably used as the material of the protection film 24 by the following reason.

When the protection film 24 is formed of the material with high viscosity, the meandered conductor 10 might be deformed during injection molding. Therefore, it is preferably to use the material with a lower viscosity than the viscosity of the material of the dielectric chip 12 during molding in the material of the protection film 24. Particularly, liquid crystal polymer is low in viscosity during molding (a melting viscosity measured in a method defined by JIS-K-7199 is 70 Pa·sec) and excellent in fluidity, and is therefore a preferable material as the material of the protection film 24.

Additionally, the protection film will not particularly be described in the following respective embodiments, but it is of course preferable to dispose the protection film.

[Third Embodiment]

Figure 5A:
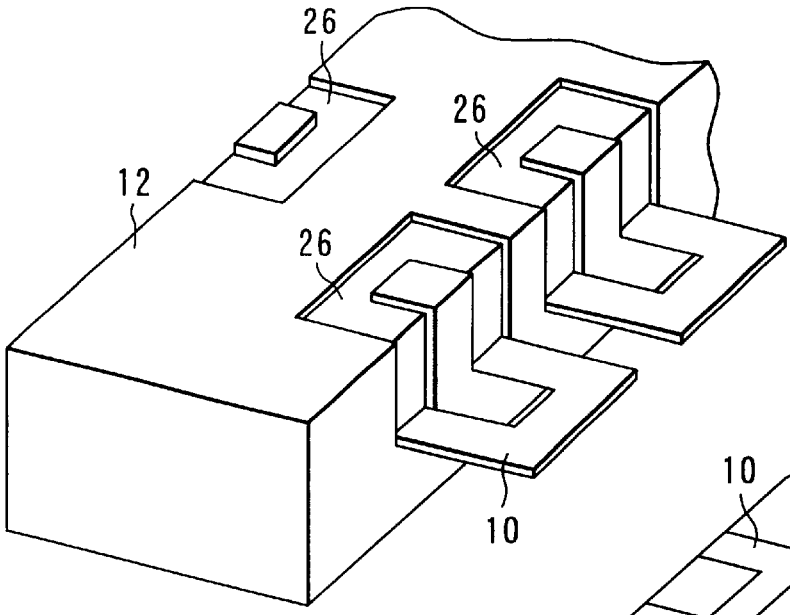
FIGS. 5A and 5B are perspective views of semimanufactures and finished goods according to the third embodiment of the chip antenna of the present invention.
Figure 5B:
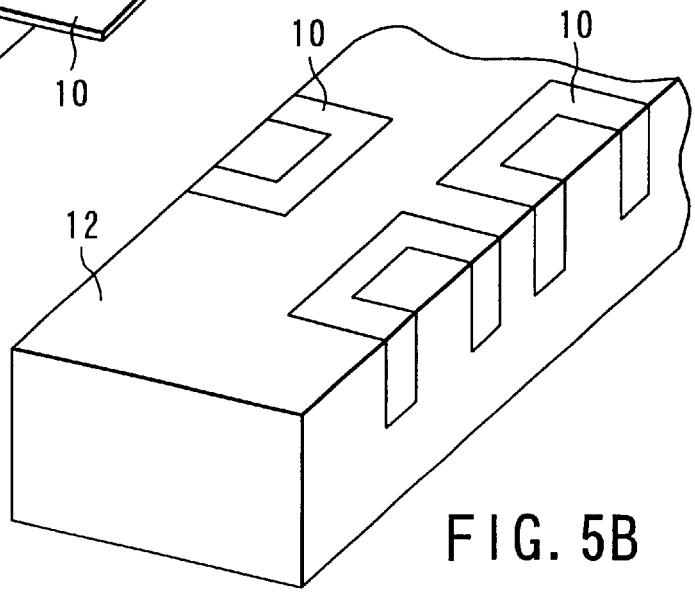

FIGS. 5A and 5B show the chip antenna according to the third embodiment of the present invention. In FIGS. 5A and 5B, the same part as that of FIG. 1 is denoted with the same reference numeral, and the detailed description thereof will be omitted. In the chip antenna according to the third embodiment, as shown in FIG. 5A, a trench 26 is further formed on the surface of the dielectric chip 12. The trench 26 is formed and disposed opposite to the conductor exposed portion of the meandered conductor 10. Then, the conductor exposed portion of the meandered conductor 10 is disposed in the trench 26 as shown in FIG. 5B.

Since the trench 26 is disposed as described above, the conductor exposed portion of the meandered conductor 10 is prevented from projecting from the surface of the dielectric chip 12. Therefore, the conductor exposed portion of the meandered conductor 10 can be prevented from deviating or being damaged.

Additionally, the trench disposed in the surface of the dielectric chip will not particularly be described in the following respective embodiments, but it is preferable to dispose the trench. Moreover, the trench may be formed to be larger than the corresponding shape of the conductor 10 as shown in FIGS. 5A and 5B. For example, a plurality of conductor exposed portions may be disposed in one trench.

[Fourth Embodiment]

Figure 6:
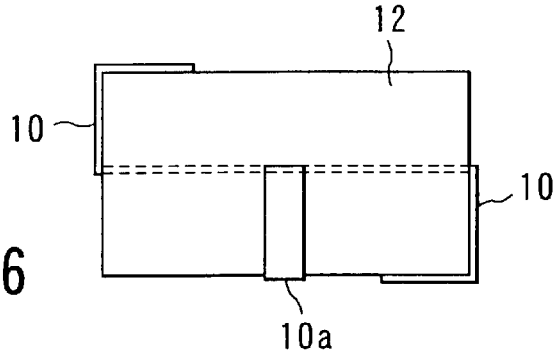
FIG. 6 is a front view showing the fourth embodiment of the chip antenna according to the present invention.

FIG. 6 is a side view of the chip antenna according to the fourth embodiment of the present invention. In FIG. 6, the same part as that of FIG. 1 is denoted with the same reference numeral, and the detailed description thereof will be omitted.

In the first to third embodiments, the meandered conductor 10 is bent on the same surface side of the dielectric chip (on an upper surface side in the drawing). In the fourth embodiment, one end portion of the meandered conductor 10 in the meander width direction is bent on the upper surface side of the dielectric chip 12, and another end portion thereof is bent on a lower surface side of the dielectric chip 12.

[Fifth Embodiment]

Figure 7A:
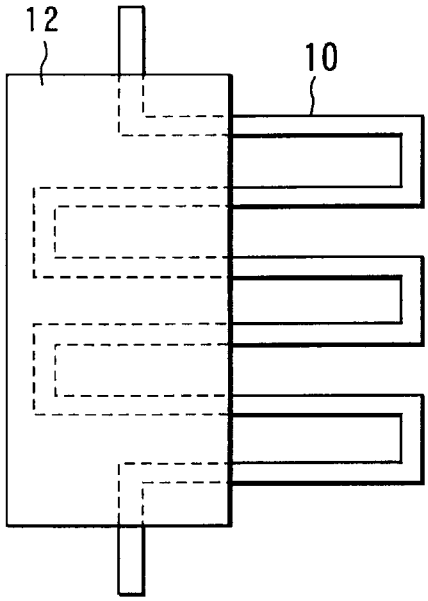
FIGS. 7A and 7B are plan views of the semimanufactures and finished goods according to the fifth embodiment of the chip antenna of the present invention.
Figure 7B:
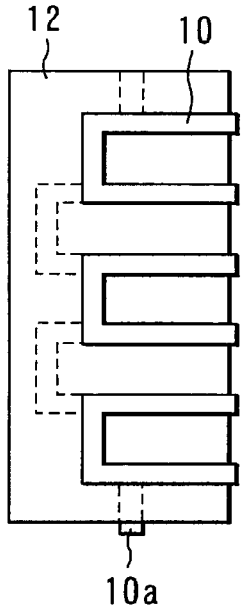

FIGS. 7A and 7B show the chip antenna according to the fifth embodiment of the present invention. In FIGS. 7A and 7B, the same part as that of FIG. 1 is denoted with the same reference numeral, and the detailed description thereof will be omitted. In the chip antenna according to the fifth embodiment, as shown in FIG. 7A, the dielectric chip 12 is formed so that one end portion of the meandered conductor 10 in the meander width direction is buried in the chip. Another end portion of the meandered conductor 10 in the meander width direction is bent as the conductor exposed portion along the surface of the dielectric chip 12 as shown in FIG. 7B.

[Sixth Embodiment]

Figure 8A:
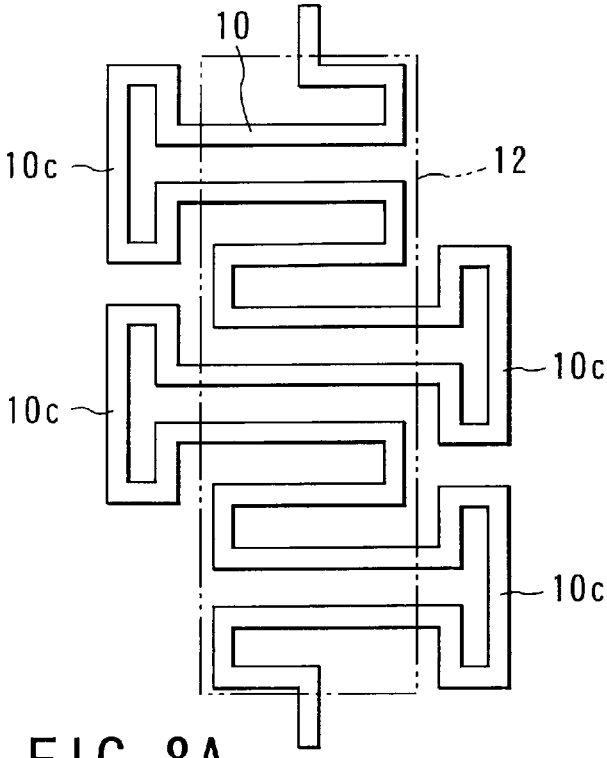
FIGS. 8A and 8B are plan views of the semimanufactures and finished goods according to the sixth embodiment of the chip antenna of the present invention.
Figure 8B:
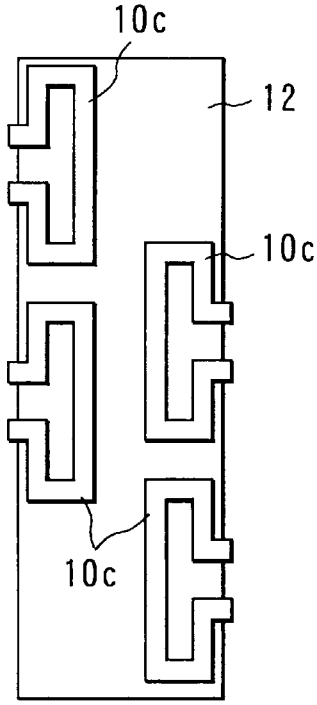

FIGS. 8A and 8B show the chip antenna according to the sixth embodiment of the present invention. In FIGS. 8A and 8B, the same part as that of FIG. 1 is denoted with the same reference numeral, and the detailed description thereof will be omitted. In the chip antenna according to the sixth embodiment, as shown in FIG. 8A, a detour portion 10*c* whose length of a meander pitch direction is ½ or more of a meander pitch is formed in a U-turn portion of the meandered conductor 10. The detour portion 10*c* is bent along the surface of the dielectric chip 12 as shown in FIG. 8B. Since the detour portion 10*c* is disposed as in the sixth embodiment, a resonance frequency of the antenna can be lowered.

[Seventh Embodiment]

Figure 9A:
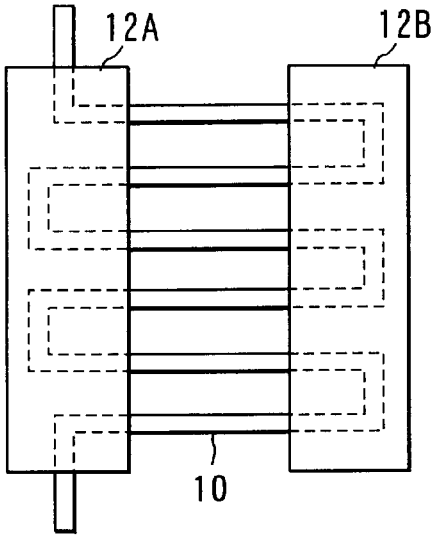
FIGS. 9A and 9B are front views of the semimanufactures and finished goods according to the seventh embodiment of the chip antenna of the present invention.
Figure 9B:
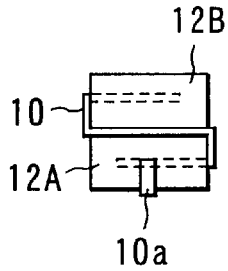

FIGS. 9A and 9B show the chip antenna according to the seventh embodiment of the present invention. In FIGS. 9A and 9B, the same part as that of FIG. 1 is denoted with the same reference numeral, and the detailed description thereof will be omitted. In the chip antenna according to the seventh embodiment, as shown in FIG. 9A, the seventh embodiment differs from FIG. 1, and two dielectric chips 12A, 12B are formed so that both end portions of the meandered conductor 10 in the meander width direction are buried in the chips, and the middle portion of the meandered conductor 10 in the meander width direction is used as the conductor exposed portion. Subsequently, the middle portion is bent, and the two dielectric chips 12A, 12B are stacked to form the chip antenna as shown in FIG. 9B. In the seventh embodiment, it is preferable to bond the stacked dielectric chips 12A, 12B to each other.

[Eighth Embodiment]

Figure 10A:
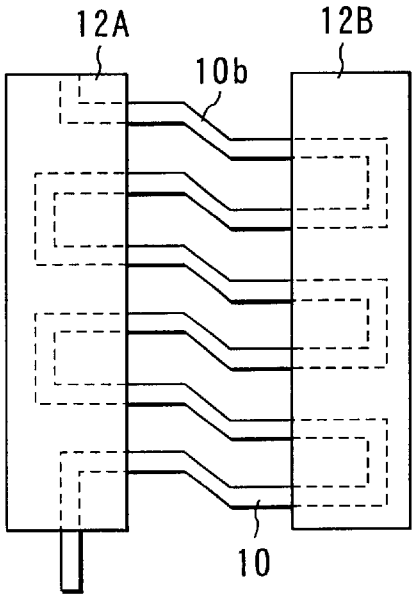
FIGS. 10A to 10D are a plan view of the semimanufactures, front view of the finished goods, plan view of the finished goods, and explanatory view of a main part of the meandered conductor according to the eighth embodiment of the chip antenna of the present invention, respectively.
Figure 10B:
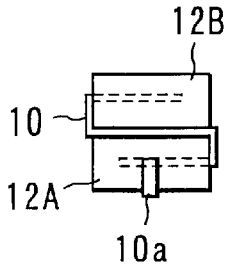
Figure 10C:
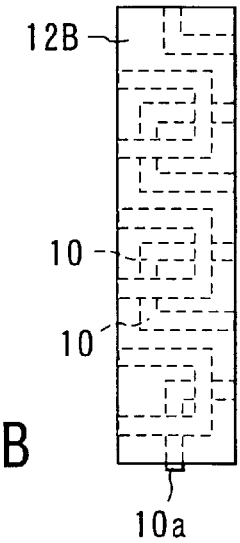
Figure 10D:
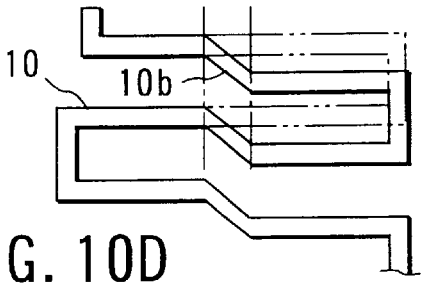

FIGS. 10A to 10D show the chip antenna according to the eighth embodiment of the present invention. In FIGS. 10A to 10D, the same part as that of FIGS. 9A and 9B is denoted with the same reference numeral, and the detailed description thereof will be omitted. The constitution of the chip antenna according to the eighth embodiment is substantially the same as that of the seventh embodiment. In the eight embodiment, as shown in FIG. 10A, an offset portion 10*b* is disposed in the conductor exposed portion of the meandered conductor 10. The offset portion 10*b* is formed so that both end portion portions of the meandered conductor 10 in the meander width direction deviate from each other by a quarter pitch in the meander pitch direction. Since the offset portion 10*b* is disposed in this manner, as shown in FIG. 10D, a conductor length of the offset portion is more than that of a portion other than the offset portion 10*b* (as shown by a two-dot chain line), and a component of the conductor 10 in the meander pitch direction can be increased. Therefore, the resonance frequency can be lowered.

[Ninth Embodiment]

FIGS. 11A and 11B show the chip antenna according to a ninth embodiment of the present invention. In FIGS. 11A and 11B, the same part as that of FIGS. 9A and 9B is denoted with the same reference numeral, and the detailed description thereof will be omitted. In the chip antenna according to the ninth embodiment, as shown in FIG. 11A, three dielectric chips 12A, 12B, 12C are formed so that three (four or more) portions of the meandered conductor 10 apart from one another in the meander width direction are buried in the chips. The three conductor chips 12A, 12B, 12C are stacked to form the chip antenna by bending the conductor exposed portion of the meandered conductor 10 and placing it between the conductor chips as shown in FIG. 11B.

In FIG. 11A, a portion of the meandered conductor 10 projecting on the left side of the dielectric chip 12A and a portion thereof projecting on the right side of the dielectric chip 12C are disposed to be held by the die during molding of the dielectric chip. A left-side projecting portion z may be cut or bent after the dielectric chip is molded. A right-side projecting portion is bent along the surface of the dielectric chip 12C as shown in FIG. 11B. It is preferable to bond the dielectric chips 12A and 12B, or 12B and 12C to each other in a stacked state as shown in FIG. 11B.

The chip antenna according to the ninth embodiment can further be miniaturized with the same conductor length as compared with the chip antenna of FIGS. 9A and 9B.

[Tenth Embodiment]

FIGS. 12A and 12B show the chip antenna according to the tenth embodiment of the present invention. In FIGS. 12A and 12B, the same part as that of FIGS. 9A and 9B is denoted with the same reference numeral, and the detailed description thereof will be omitted. In the chip antenna according to the tenth embodiment, as shown in FIG. 12A, two dielectric chips 12A, 12B are formed so that both end portions of the meandered conductor 10 in the meander pitch direction (not in the meander width direction) are buried in the chips. Moreover, the middle portion of the meandered conductor 10 in the meander pitch direction (i.e., the portion which is not buried in the dielectric chips 12A, 12B) is bent as shown in FIG. 12B, and the two dielectric chips 12A, 12B are stacked to form the chip antenna. It is preferable to bond the stacked dielectric chips 12A, 12B to each other.

[Eleventh Embodiment]

Figure 13A:
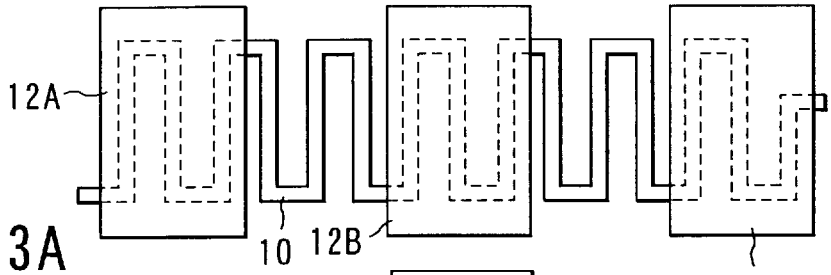
FIGS. 13A and 13B are a plan view of the semimanufactures and a side view of the finished goods according to the eleventh embodiment of the chip antenna of the present invention, respectively.
Figure 13B:
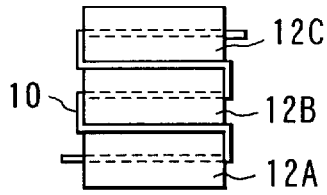

FIGS. 13A and 13B show the chip antenna according to the eleventh embodiment of the present invention. In FIGS. 13A and 13B, the same part as that of FIGS. 12A and 12B is denoted with the same reference numeral, and the detailed description thereof will be omitted. In the chip antenna according to the eleventh embodiment, as shown in FIG. 13A, three dielectric chips 12A, 12B, 12C are formed so that three (four or more) portions of the meandered conductor 10 apart from one another in the meander pitch direction are buried in the chips. The middle portion of the meandered conductor 10 in the meander pitch direction, which is not buried in the dielectric chip, is bent as shown in FIG. 13B, and the three conductor chips 12A, 12B, 12C are stacked to form the chip antenna.

The chip antenna of the eleventh embodiment can further be miniaturized with the same conductor length as compared with the chip antenna of FIGS. 10A to 10D.

[Twelfth Embodiment]

Figure 14A:
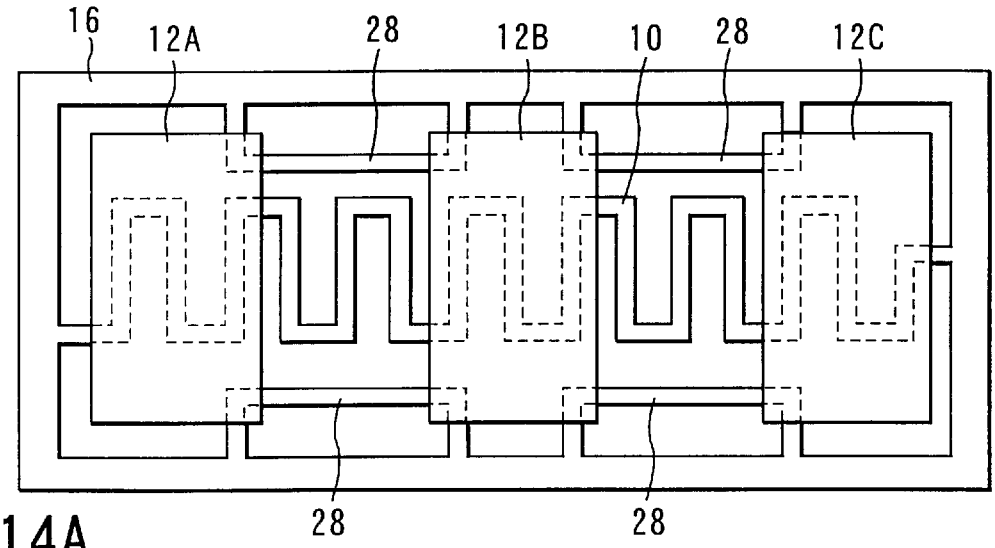
FIGS. 14A to 14C are a plan view showing a state during manufacturing, plan view of the semimanufactures and side view of the finished goods according to the twelfth embodiment of the chip antenna of the present invention, respectively.
Figure 14B:
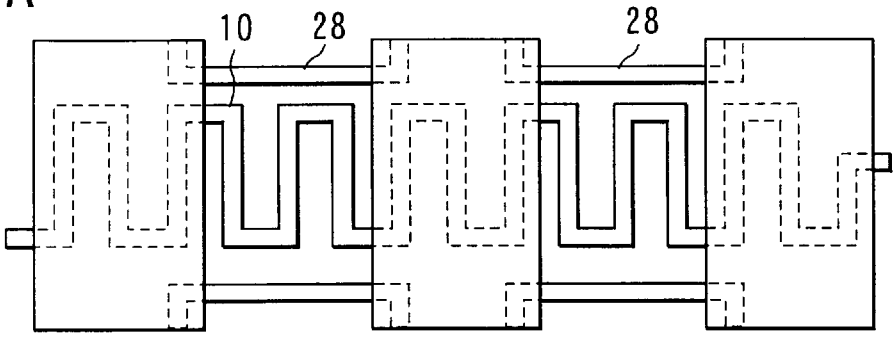
Figure 14C:
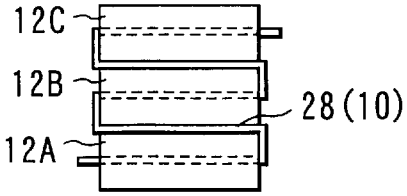

FIGS. 14A to 14C show the chip antenna according to the twelfth embodiment of the present invention. In the chip antenna shown in FIGS. 12A, 12B, 13A, and 13B, when a plurality of dielectric chips are stacked, the portion of the meandered conductor not buried in the dielectric chip is possibly extended (i.e., a meander pitch might increase). This problem is improved in the twelfth embodiment.

Manufacturing steps of the chip antenna of the twelfth embodiment will be described in order. First, a copper tape is punched or etched to form the conductor pattern 14 as shown in FIG. 14A. In the conductor pattern 14, the meandered conductor 10, an extension prevention member 26, and a frame 16 are integrally formed. The extension prevention member 26 is formed in a predetermined length in the meander pitch direction on both sides of the meandered conductor 10. The frame 16 surrounds the meandered conductor 10 and extension prevention member 26. Subsequently, the dielectric chips 12A, 12B, 12C are formed in portions of the conductor pattern 14 as shown by broken lines. That is, three portions of the meandered conductor 10 apart from one another in the meander pitch direction, and both end portions of each extension prevention member 26 are buried in the dielectric chips 12A, 12B, 12C.

Subsequently, the meandered conductor 10 and extension prevention member 26 are cut and separated from the frame 16 as shown in FIG. 14B. In this state, the extension prevention member 26 is electrically insulated from the meandered conductor 10. Portions between 12A—12A and 12B—12B of the dielectric chips are connected to each other on both sides of the meandered conductor 10, so that the meandered conductor 10 can be prevented from being extended.

Subsequently, portions of the meandered conductor 10 and extension prevention member 26 which are not buried in the dielectric chips are bent, and the dielectric chips 12A, 12B, 12C are stacked, so that the chip antenna of FIG. 14C can be obtained. In the chip antenna, when the meandered conductor 10 is bent, the meandered conductor 10 is prevented from being extended by the extension prevention member 26. Therefore, dispersion of the meander pitch is eliminated and the stable property is obtained.

[Thirteenth Embodiment]

Figure 15A:
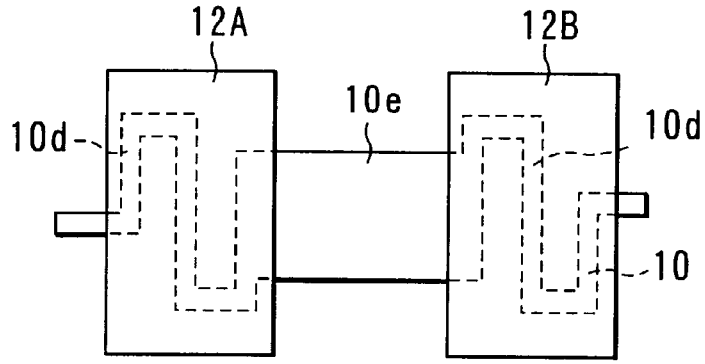
FIGS. 15A and 15B are a plan view of the semimanufactures and a side view of the finished goods according to the thirteenth embodiment of the chip antenna of the present invention, respectively.
Figure 15B:
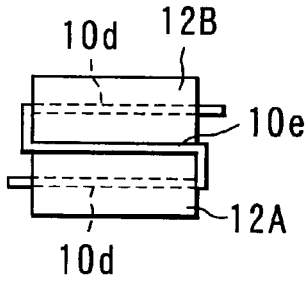

FIGS. 15A and 15B show the chip antenna according to the thirteenth embodiment of the present invention. In FIGS. 15A and 15B, the same part as that of FIGS. 12A and 12B is denoted with the same reference numeral, and the detailed description thereof will be omitted. In the chip antenna according to the thirteenth embodiment, as shown in FIG. 15A, a meandered portion 10*d*, and a banding portion 10*e* which is not meandered are alternately disposed in the meander pitch direction of the meandered conductor 10. A plurality of dielectric chips 12A, 12B are formed so that the meandered portion 10 *d* is buried in the chips. Furthermore, the banding portion 10*e* (i.e., the portion which is not buried in the dielectric chips 12A, 12B) is bent as shown in FIG. 15B, the plurality of dielectric chips 12A, 12B are stacked, and the chip antenna is formed. Since the dispersion of the meander pitch can be eliminated even in this constitution, the chip antenna having a stable property can be obtained. By providing the broad banding portion 10*e* in the middle portion, a bandwidth can slightly be broadened.

[Fourteenth Embodiment]

Figure 16A:
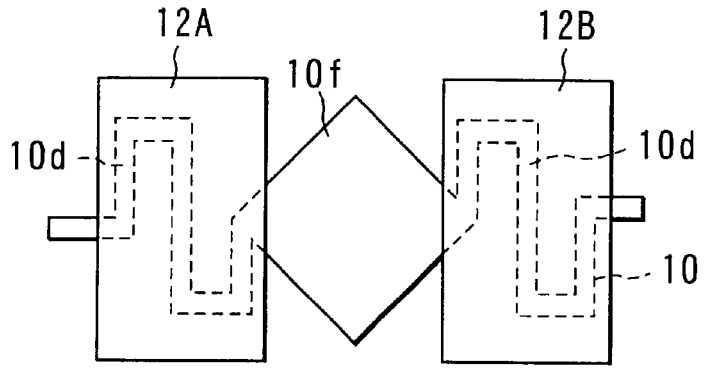
FIGS. 16A and 16B are a plan view of the semimanufactures and a side view of the finished goods according to the fourteenth embodiment of the chip antenna of the present invention, respectively.
Figure 16B:
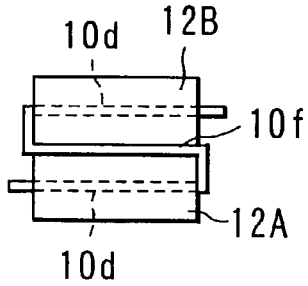

FIGS. 16A and 16B show the chip antenna according to the fourteenth embodiment of the present invention. In FIGS. 16A and 16B, the same part as that of FIGS. 15A and 15B is denoted with the same reference numeral, and the detailed description thereof will be omitted. In the chip antenna according to the fourteenth embodiment, as shown in FIG. 16A, the meandered portion 10*d*, and a rhombic portion 10*f* which is not meandered are alternately disposed in the meander pitch direction of the meandered conductor 10. A plurality of dielectric chips 12A, 12B are formed so that the meandered portion 10*d* is buried in the chips. Furthermore, the rhombic portion 10*f* is bent as shown in FIG. 16B, the plurality of dielectric chips 12A, 12B are stacked, and the chip antenna is formed. Since the dispersion of the meander pitch can be eliminated even in this constitution, the chip antenna having the stable property can be obtained.

[Fifteenth Embodiment]

Figure 17A:
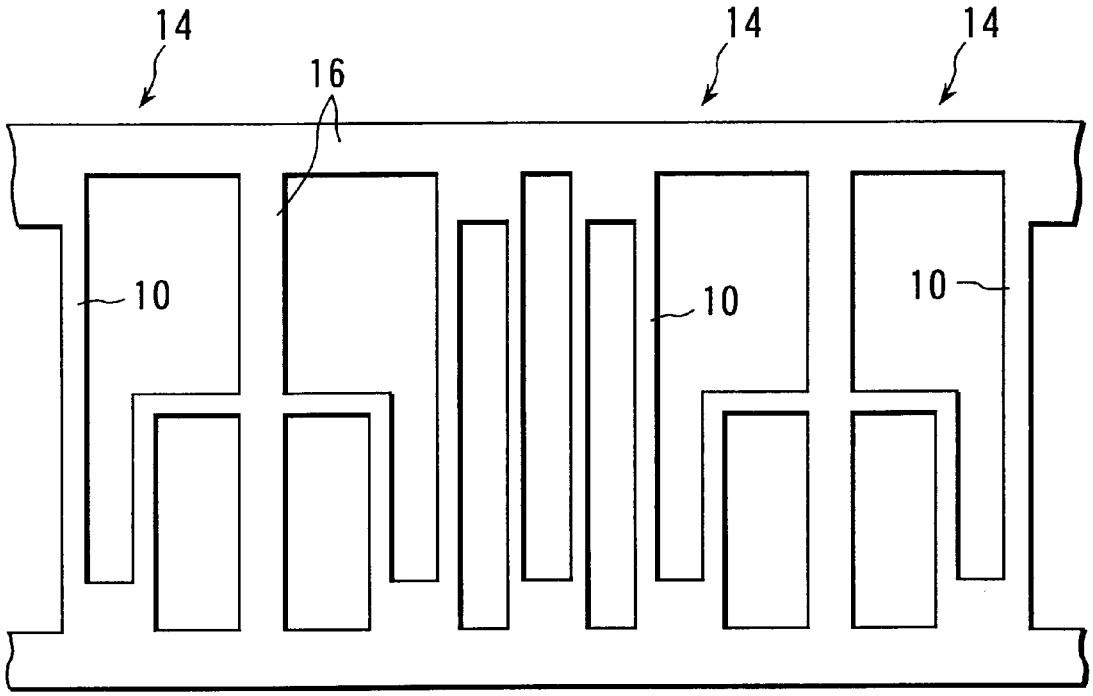
FIGS. 17A and 17B are explanatory views showing the fifteenth embodiment of the chip antenna of the present invention, and showing a more preferable example of the manufacturing method of the chip antenna of FIG. 1.
Figure 17B:
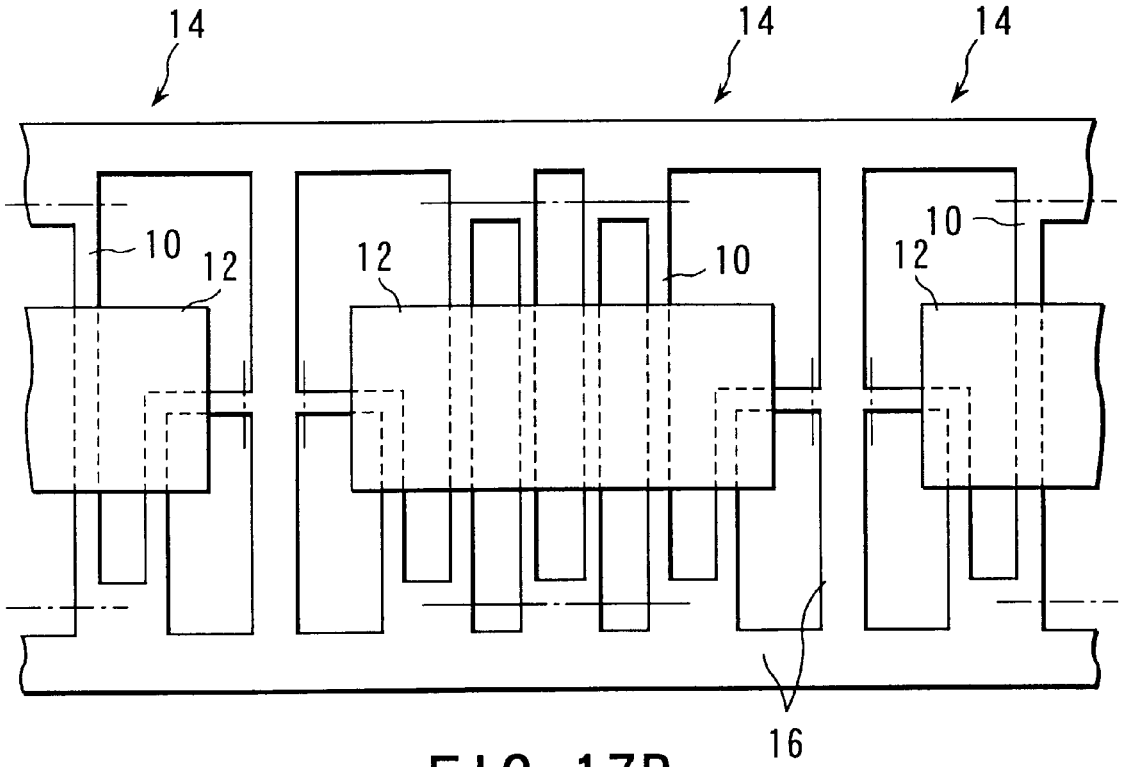

FIGS. 17A and 17B show the chip antenna according to the fifteenth embodiment of the present invention. The conductor pattern of FIG. 17A is the same as the conductor pattern of FIG. 2A of the first embodiment. In the conductor pattern 14, the whole width of the U-turn portion of the meandered conductor 10 is formed integrally with the frame 16 (i.e., the width of the bridge 18 is set to be the same as the whole width of the U-turn portion of the meandered conductor 10). Similarly as the first embodiment, the conductor pattern 14 is set in the dielectric material molding die, and the dielectric chip 12 is formed as shown in FIG. 17B. In this case, since the whole width of the U-turn portion of the meandered conductor 10 is formed integrally with the frame 16 in the conductor pattern 14, the dielectric chip 12 can be formed without damaging the shape of the meandered conductor 10. Thereafter, the meandered conductor 10 is separated from the frame 16 in a position shown by a dashed line of FIG. 17B. Subsequently, similarly as the first embodiment, the portion, which is not buried in the dielectric chip 12, is bent along the surface of the dielectric chip 12. After this step, the chip antenna similar to that of the first embodiment can be obtained.

As described above, when a pattern in which the whole width of the U-turn portion of the meandered conductor 10 is formed integrally with the frame 16 (i.e., the width of the bridge 18 is set to be the same as or larger than the whole width of the U-turn portion of the meandered conductor 10) is used as the conductor pattern 14, deformation of the meandered conductor during molding of the dielectric chip can further be reduced, as compared with the conductor pattern of FIGS. 2A to 2C in which the meandered conductor 10 is connected to the frame 16 via the thin bridge 18.

[Sixteenth Embodiment]

Figure 18A:
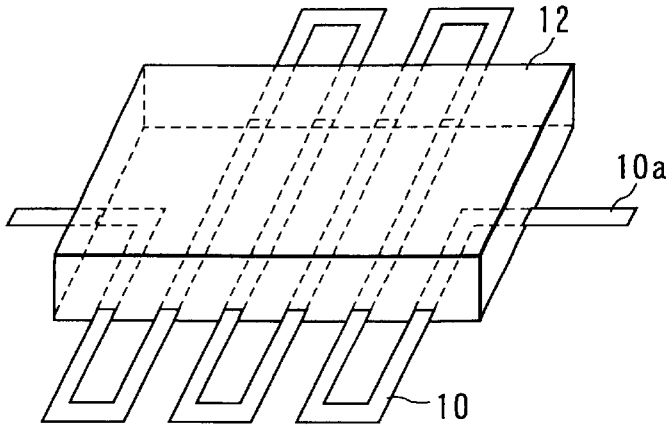
FIGS. 18A to 18C are views of a chip antenna according to the seventh embodiment of the present invention.
Figure 18B:
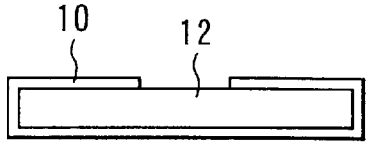
Figure 18C:
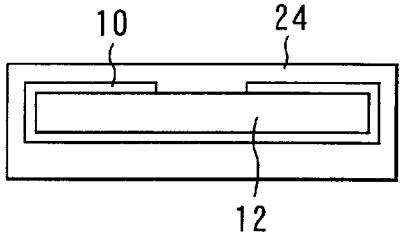

FIGS. 18A to 18C show the chip antenna according to the sixteenth embodiment of the present invention. In FIGS. 18A to 18C, the same part as that of FIG. 1 is denoted with the same reference numeral, and the detailed description thereof will be omitted. In the chip antenna according to the sixteenth embodiment, the dielectric chip 12 is stacked only on an upper side of the meandered conductor 10 as shown in FIG. 18A. That is, the dielectric chip 12 is provided to be stacked on an intermediate portion in the meander width direction of the meandered conductor 10. In other word, the intermediate portion of the meandered conductor 10 is put on under surface of the dielectric chip 12. And, both end portions in the meander width direction of the meandered conductor 10, which is the conductor exposed portion are bent along the side surface and the upper surface of the dielectric chip 12 as shown in FIG. 18B. In the antenna shown in FIG. 18B, it is preferable to provide the protection film 24 to cover the lower surface, the side surface, and the upper surface, for example, as shown in FIG. 18C, if necessary.

[Seventeenth Embodiment]

Figure 19A:
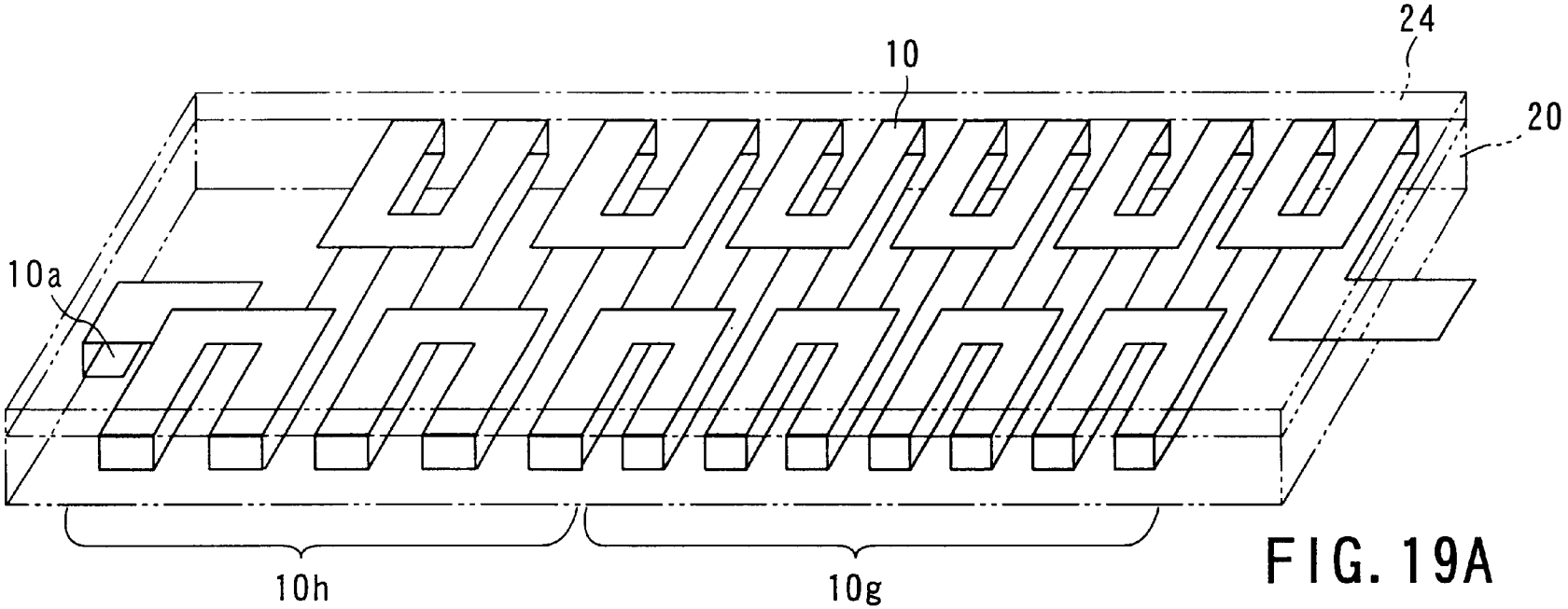
FIGS. 19A and 19B are views showing one example of the chip antenna of the present invention, which is applied to a mobile phone as a comparative example with respect to a conventional antenna.
Figure 19B:
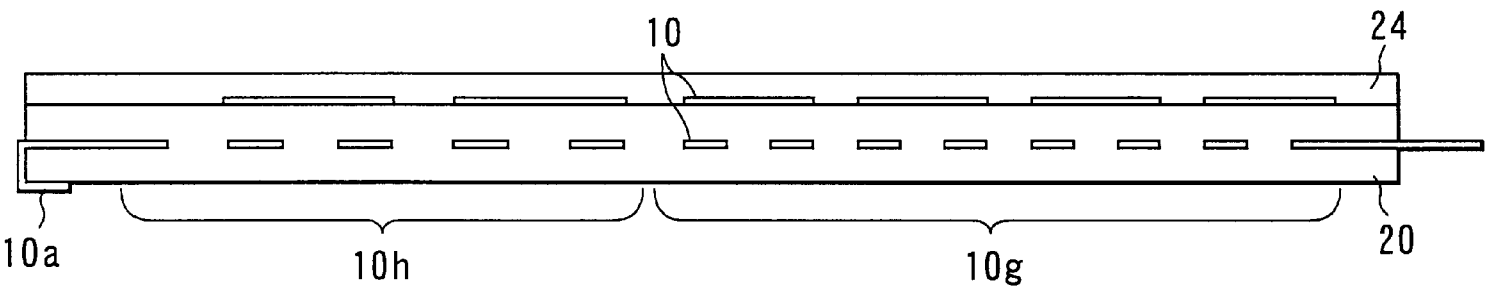

In each embodiment as mentioned above, the shape, and the like of the antenna itself is described. In the seventeenth embodiment, an embodiment in which the chip antenna according to the present invention is applied to a mobile communication terminal (including a mobile phone, and a personal handy phone (PHS)) will be described. In the seventeenth embodiment, the meandered conductor shown in FIGS. 19A and 19B is used as the antenna. In FIGS. 19A and 19B, the same part as that of FIGS. 4A and 4B is denoted with the same reference numeral.

In FIGS. 19A and 19B, a size of each portion is as follows. As shown in FIGS. 19A and 19B, a dense meander pitch portion 10*g* and coarse meander pitch portion 10*h* are formed.

Meander width of the meandered conductor: 8.7 mm
Thickness of the meandered conductor: 100 $\mu$m
Portion in which the meander pitch is dense: line width/line interval =140/160 $\mu$m 26 turns
Portion in which the meander pitch is coarse: line width/line interval =180/220 $\mu$m 18 turns
Length, width, thickness of the dielectric chip: 16×3.8×0.9 mm
Permittivity of the dielectric chip: 20
Outer size of the dielectric material after secondary coating: 16×4.4×1.2 mm
Permittivity of a secondary coating resin: 3.4
A center frequency of the chip antenna is 878 MHz.

Figure 20:
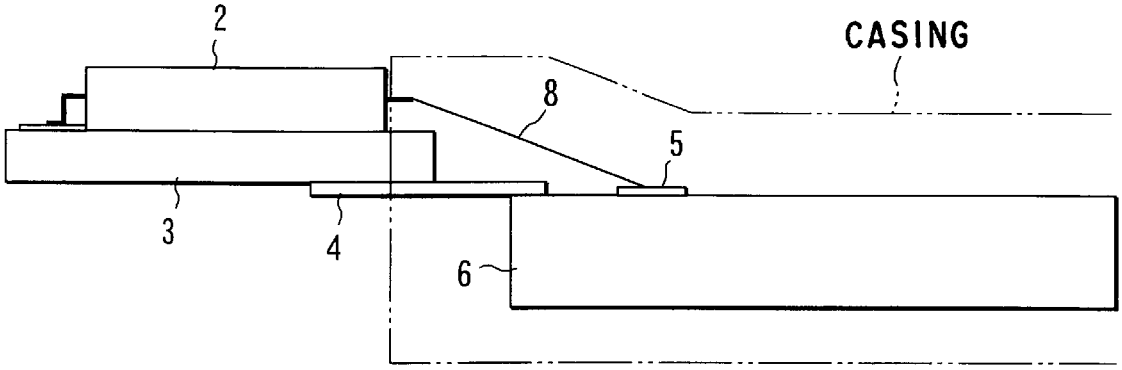
FIG. 20 is a view showing an example in which the chip antenna of the present invention is applied to the mobile phone for a comparison test with respect to the conventional antenna.

Tow mobile commercial mobile phones to which the WHIP antenna is installed is acquired, the WHIP antenna of one of the mobile phone is removed, the aforementioned meandered antenna is attached to the mobile phone shown in FIG. 20, and then antenna properties are confirmed. In FIG. 20, a feed point 5 disposed on a substrate 6 of the mobile phone is connected to an antenna 2 through and feed conductor 8. The antenna 2 is mounted on an antenna holding substrate 3, and the antenna holding substrate 3 is connected to the substrate 6 of the mobile phone through a ground extending copper foil 4. In this manner, the mobile phone to be tested is constituted by replacing a whip antenna of the mobile phone with the antenna of the present invention.

The property of the mobile phone (hereinafter referred to as "terminal A") with the antenna of the present invention constituted as described above attached thereto was compared with the property of the mobile phone (hereinafter referred to as "terminal B") with the conventional whip antenna used therein.

Positions of the terminals A and B are set to a point remote from a base station and slight in a radio wave (e.g., the place remote from the base station by 13 km). A fixed phone is used as a terminal for calling the mobile terminal or receiving a call.

In order to set transmission/reception test conditions to be the same in the positions of the terminals A and B, the positions of the terminals A and B are switched by a predetermined number of times (e.g., 20 times) during conducting of a test. Both the terminals A and B are subjected to each of a waiting/receiving test and transmitting test 80 times. The terminal B is tested while the whip antenna is extended.

When the aforementioned test is carried out, the following results are obtained. Numeric values in the following table indicate times by which the receiving or the transmitting is succeeded.

| | | Terminal A | Terminal B |
|---|---|---|---|
| (1) | Receiving test | 45 | 25 |
| (2) | Transmitting test | 54 | 48 |

According to the aforementioned results, when the antenna of the present invention is applied to the mobile terminal, transmission/reception can be performed with a higher probability as compared with the conventional ones both in the receiving test and the transmitting test.

As mentioned above, the chip antenna according to the present invention is characterized by comprising: an antenna conductor, and a dielectric chip which stacks on a portion of the antenna conductor, in which a conductor exposed portion of the antenna conductor which is not overlapped on the dielectric chip is bent along the surface of the dielectric chip.

Preferred manners for carrying out the present invention are as follows. The following respective manners may be applied solely, or as an appropriate combination of two or more thereof.

(1) The antenna conductor is a meandered conductor formed in a meandered shape.

(2) It is preferable to use conductors formed by punching or etching a metal plate as the meandered conductor in order to enhance mass productivity.

(3) The meandered conductor may be formed by bending a linear material.

(4) It is preferable to use plastic or material made by mixing the plastic and the ceramics as the material of the dielectric chip in respect of ease of molding and mass productivity.

(5) There is a portion of the conductor in a meander width direction or a meander pitch direction as the portion of the meandered conductor to be buried in the dielectric chip.

(6) In the chip antenna of (1), the dielectric chip is formed such that the meandered conductor is overlapped to a middle portion of a meander width direction.

(7) In the chip antenna of (1), the dielectric chip is formed such that the meandered conductor is overlapped to a middle portion of a meander width direction.

(8) The dielectric chip comprises a plurality of dielectric chips arranged apart from one another in a meander width direction of the meandered conductor, the conductor exposed portion of the meandered conductor is bent, and the plurality of dielectric chips are stacked.

(9) The dielectric chip comprises a plurality of dielectric chips arranged apart from one another in a meander pitch direction of the meandered conductor, the conductor exposed portion of the meandered conductor is bent, and the plurality of dielectric chips are stacked.

(10) In the chip antenna of (9), an extension prevention member configured to prevent the meandered conductor from extending in a meander pitch direction is further provided. It is preferable that the extension prevention member is insulated to the meandered conductor, but may be formed by a portion of the meandered conductor.

(11) A trench in which the bent conductor is to be disposed is formed in the surface of the dielectric chip.

(12) An overlapped portion of the antenna conductor is buried in the dielectric chip.

(13) A protection film to cover the conductor exposed portion is further provided.

(14) In the chip antenna of (12), the protection film is formed of a resin material having a viscosity during molding which is lower than the viscosity of the dielectric chip.

A manufacturing method of a chip antenna is characterized by comprising forming a conductor pattern having a meandered conductor, and forming a dielectric chip so as to overlap at least a portion of the meandered conductor in a meander width direction or a meander pitch direction in the dielectric chip. It is preferable that the conductor pattern has a pattern in which the meandered conductor and a frame to surround the meandered conductor are integrally formed, and after forming the dielectric chip, the meandered conductor is separated from the frame and a portion excluding a portion which is buried in the dielectric chip is bent along a surface of the dielectric chip.

As described above, according to the present invention, the antenna can be miniaturized. In addition, the chip antenna with high mass productivity and low cost can be obtained.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A chip antenna comprising a dielectric chip having a first axis and a plurality of external surfaces and an antenna conductor partially arranged inside said dielectric chip;

wherein the antenna conductor has a first end and a second end, wherein the antenna conductor has a meandering portion between the first end and second end, wherein the meandering portion has a width and a length, wherein the length is parallel to the first axis of the dielectric chip and the width is perpendicular to the first axis of the dielectric chip, wherein all of the length of the meandering portion is arranged inside the dielectric chip, and only a part of the width of the meandering portion extends out from the dielectric chip, and wherein the part of the width of the meandering portion that extends out from the dielectric chip is bent against at least one of the external surfaces of the dielectric chip.

2. The chip antenna according to claim 1, wherein the dielectric chip comprises a trench, in which the antenna conductor is to be disposed, on at least one external surface.

3. The chip antenna according to claim 1, further comprising a protection film to cover the part of the width of the meandering portion that extends out from the dielectric chip.

4. A method of a chip antenna comprising:

forming a dielectric chip having a first axis having a plurality of external surfaces;

forming a conductor pattern having an antenna conductor, wherein the antenna conductor has a first end and second end, wherein the antenna conductor has a meandering portion between the first end and second end, wherein the meandering portion has a width and a length, wherein the length is parallel to the first axis of the dielectric chip and the width is perpendicular to the first axis of the dielectric chip;

arranging the antenna conductor inside the dielectric chip, such that all of the length of the meandering portion is within the dielectric chip and only a part of the width of the meandering portion extends out from the dielectric chip, and bending the part of the width of the meandering portion of said antenna conductor that extends out from the dielectric chip along at least one of the external surfaces of the dielectric chip.

5. The manufacturing method according to claim 4, wherein said conductor pattern has a pattern, in which the antenna conductor and a frame surrounding the antenna conductor are integrally formed; and after forming the dielectric chip, separating the antenna conductor from the frame.

6. A chip antenna comprising:

a dielectric chip having a first axis and a plurality of external surfaces and an antenna conductor partially arranged inside said dielectric chip;

wherein the antenna conductor has a first end and a second end, wherein the antenna conductor has a meandering portion between the first end and second end, wherein the meandering portion has a width and a length, wherein the length is parallel to the first axis of the dielectric chip and the width is perpendicular to the first axis of the dielectric chip, wherein all of the width of the meandering portion is arranged inside the dielectric chip, and only a part of the length of the meandering portion extends out from the dielectric chip, and wherein the part of the length of the meandering portion that extends out from the dielectric chip is bent against at least one of the external surfaces of the dielectric chip.

7. The chip antenna according to claim 6, wherein a trench, in which the antenna conductor is to be disposed, is formed on at least one surface of the dielectric chip.

8. The chip antenna according to claim 6, further comprising a protection film to cover the part of the length of the meandering portion that extends out from the dielectric chip.

9. A manufacturing method of a chip antenna comprising:

forming a dielectric chip having a first axis having a plurality of external surfaces;

forming a conductor pattern having an antenna conductor, wherein the antenna conductor has an input and an output approximately aligned with said first axis and extending out from respective opposite ends of said dielectric chip, wherein the antenna conductor has a meandering portion between the input and output, wherein the meandering portion has a width and a length, wherein the length is parallel to the first axis of the dielectric chip and the width is perpendicular to the first axis of the dielectric chip;

burying the antenna conductor in the dielectric chip, such that all of the width of the meandering portion is within the dielectric chip and only a part of the length of the meandering portion extends out from the dielectric chip, and bending the part of the length of the meandering portion of said antenna conductor that extends out from the dielectric chip along at least one of the external surfaces of the dielectric chip.

10. The manufacturing method according to claim 9, wherein said conductor pattern has a pattern, in which the antenna conductor and a frame surrounding the antenna conductor are integrally formed; and after forming the dielectric chip, separating the antenna conductor from the frame.

11. A chip antenna comprising:

an antenna conductor comprising a meandered conductor;

a dielectric chip which stacks on a portion of said antenna conductor, wherein a conductor exposed portion of said antenna conductor which is not overlapped on the dielectric chip is bent along the surface of the dielectric chip, wherein said dielectric chip is formed such that said dielectric chip is overlapped to a middle portion of a meander width direction.

12. A chip antenna comprising:

an antenna conductor comprising a meandered conductor;

at least one dielectric chip which stacks on a portion of said antenna conductor, wherein a conductor exposed portion of said antenna conductor which is not overlapped on the at least one dielectric chip is bent along the surface of the at least one dielectric chip, wherein said at least one dielectric chip comprises a plurality of dielectric chips arranged apart from one another in a meander width direction of said meandered conductor, wherein said conductor exposed portion of said meandered conductor is bent such that said plurality of dielectric chips are stacked.

13. A chip antenna comprising:

an antenna conductor comprising a meandered conductor;

at least one dielectric chip which stacks on a portion of said conductor, wherein a conductor exposed portion of said antenna conductor which is not overlapped on the at least one dielectric chip is bent along the surface of the at least one dielectric chip, wherein said at least one dielectric chip comprises a plurality of dielectric chips arranged apart from one another in a meander width direction of said meandered conductor, wherein said conductor exposed portion of said meandered conductor is bent such that said plurality of dielectric chips are stacked.

14. The chip antenna according to claim 13, further comprising an extension prevention member configured to prevent the meandered portion from extending out from the dielectric chip.

15. A chip antenna comprising:

an antenna conductor;

a dielectric chip which stacks on a portion of said antenna conductor, wherein a conductor exposed portion of said antenna conductor which is not overlapped on the dielectric chip is bent along the surface of the dielectric chip, wherein said dielectric chip is formed such that said meandered conductor is overlapped to a middle portion of a meander width direction a protection film to cover the part of the meandering portion that extends out from the dielectric chip, wherein said protection film is formed of a resin material having a viscosity during molding which is lower than a viscosity of said dielectric chip.

16. A chip antenna comprising:

a dielectric chip having a first axis and a plurality of external surfaces and an antenna conductor partially arranged inside said dielectric chip;

wherein the antenna conductor has a first end and a second end, wherein the antenna conductor has a meandering portion between the first end and second end, wherein the meandering portion has a width and a length, wherein the length is parallel to the first axis of the dielectric chip and the width is perpendicular to the first axis of the dielectric chip, wherein all of the width of the meandering portion is arranged inside the dielectric chip, and only a part of the length of the meandering portion extends out from the dielectric chip, and wherein the part of the length of the meandering portion that extends out from the dielectric chip is bent against at least one of the external surfaces of the dielectric chip, and wherein said dielectric chip is formed such that said dielectric chip is overlapped to a middle portion of the length.

17. A chip antenna comprising:

a dielectric chip having a first axis and a plurality of external surfaces and an antenna conductor partially arranged inside said dielectric chip;

wherein the antenna conductor has a first end and a second end, wherein the antenna conductor has a meandering portion between the first end and second end, wherein the meandering portion has a width and a length, wherein the length is parallel to the first axis of the dielectric chip and the width is perpendicular to the first axis of the dielectric chip, wherein all of the width of the meandering portion is arranged inside the dielectric chip, and only a part of the length of the meandering portion extends out from the dielectric chip, and wherein the part of the length of the meandering portion that extends out from the dielectric chip is bent against at least one of the external surfaces of the dielectric chip, and wherein said dielectric chip is formed such that said meandering portion is arranged inside one end portion of the length.

18. A chip antenna comprising:

at least one dielectric chip having a first axis and a plurality of external surfaces and an antenna conductor partially arranged inside said at least one dielectric chip;

wherein the antenna conductor has a first end and a second end, wherein the antenna conductor has a meandering portion between the first end and second end, wherein the meandering portion has a width and a length, wherein the length is parallel to the first axis of the dielectric chip and the width is perpendicular to the first axis of the at least one dielectric chip, wherein all of the width of the meandering portion is arranged inside the at least one dielectric chip, and only a part of the length of the meandering portion extends out from the at least one dielectric chip, and wherein the part of the length of the meandering portion that extends out from the at least one dielectric chip is bent against at least one of the at least one external surfaces of the at least dielectric chip, and wherein said at least one dielectric chip comprises a plurality of dielectric chips arranged apart from one another in the length of the meandering portion, and wherein said plurality of dielectric chips are stacked.

19. A chip antenna comprising:

at least one dielectric chip having a first axis and a plurality of external surfaces and an antenna conductor partially arranged inside said at least one dielectric chip;

wherein the antenna conductor has a first end and a second end, wherein the antenna conductor has a meandering portion between the first end and second end, wherein the meandering portion has a width and a length, wherein the length is parallel to the first axis of the dielectric chip and the width is perpendicular to the first axis of the at least one dielectric chip, wherein all of the width of the meandering portion is arranged inside the at least one dielectric chip, and only a part of the length of the meandering portion extends out from the at least one dielectric chip, and wherein the part of the length of the meandering portion that extends out from the at least one dielectric chip is bent against at least one of the external surfaces of the at least one dielectric chip, and wherein said at least one dielectric chip comprises a plurality of dielectric chips arranged apart from one another in the width of the meandering portion, and wherein said plurality of dielectric chips are stacked.

20. A chip antenna comprising:

a dielectric chip having a first axis and a plurality of external surfaces and an antenna conductor partially arranged inside said dielectric chip;

wherein the antenna conductor has a first end and a second end, wherein the antenna conductor has a meandering portion between the first end and second end, wherein the meandering portion has a width and a length, wherein the length is parallel to the first axis of the dielectric chip and the width is perpendicular to the first axis of the dielectric chip, wherein all of the length of the meandering portion is arranged inside the dielectric chip, and only a part of the width of the meandering portion extends out from the dielectric chip, and wherein the part of the width of the meandering portion that extends out from the dielectric chip is bent against at least one of the external surfaces of the dielectric chip, and a protection film, wherein the film covers the part of the length of the meandering portion that extends out from the dielectric chip, and wherein the film is formed of a resin material having a viscosity during molding which is lower than a viscosity of the dielectric chip.

21. A chip antenna comprising:

a dielectric chip having a first axis and a plurality of external surfaces and an antenna conductor partially arranged inside said dielectric chip;

wherein the antenna conductor has a first end and a second end, wherein the antenna conductor has a meandering portion between the first end and second end, wherein the meandering portion has a width and a length, wherein the length is parallel to the first axis of the dielectric chip and the width is perpendicular to the first axis of the dielectric chip, wherein all of the width of the meandering portion is arranged inside the dielectric chip, and only a part of the length of the meandering portion extends out from the dielectric chip, and wherein the part of the length of the meandering portion that extends out from the dielectric chip is bent against at least one of the external surfaces of the dielectric chip, and a protection film, wherein the film covers the part of the length of the meandering portion that extends out from the dielectric chip, and wherein the film is formed of a resin material having a viscosity during molding which is lower than a viscosity of the dielectric chip.

* * * * *